United States Patent [19]

Millman et al.

[11] Patent Number: 5,072,977

[45] Date of Patent: Dec. 17, 1991

[54] PADDLE LATCH DEVICE

[75] Inventors: Norman A. Millman, Dresher; Fouad F. Korban, Flourtown, both of Pa.

[73] Assignee: Trans-Atlantic Company, Philadelphia, Pa.

[21] Appl. No.: 737,187

[22] Filed: Jul. 29, 1991

[51] Int. Cl.[5] ..... E05C 15/02

[52] U.S. Cl. ..... 292/336.3; 292/92; 292/244; 292/172

[58] Field of Search ..... 292/336.3, 93, 347, 292/244, 245, 172, 173, 199, 226, 92

[56] References Cited

U.S. PATENT DOCUMENTS 3,561,805 2/1971 Shaw ..... 292/172

3,869,159 3/1975 Eads ..... 292/92

4,725,085 2/1988 Hu et al. ..... 292/172

*Primary Examiner*—Richard E. Moore

*Attorney, Agent, or Firm*—Walter B. Udell

[57] ABSTRACT

A latch retraction device for narrow stile doors which may be hinged either on the left side or on the right side, and which utilizes a push or pull actuator for retracting the latch instead of utilizing a rotary knob for that purpose. The device utilizes inter-engaged toothed elements to provide linear to rotary motion in a novel configuration of parts which permits one set of parts to be utilized to provide either a push or a pull actuation for latch retraction with either a right hand or left hand door and thereby eliminating the necessity to manufacture and inventory a large number of parts to accommodate all four types of desired uses.

16 Claims, 5 Drawing Sheets

FIG. 1
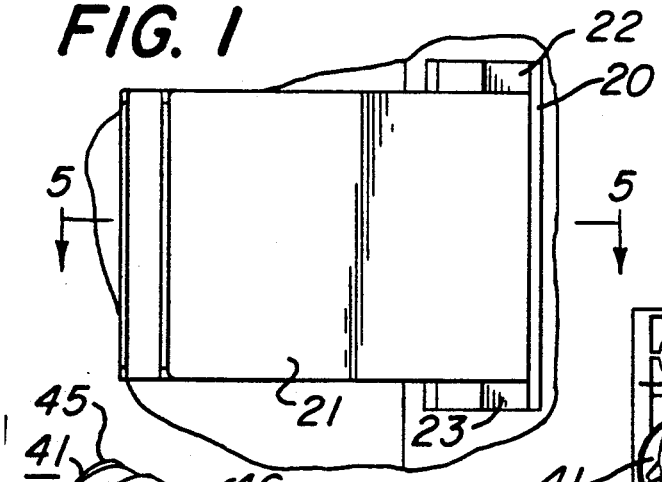
FIG. 3
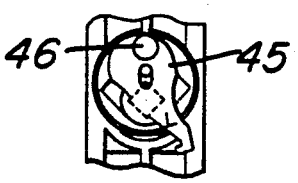
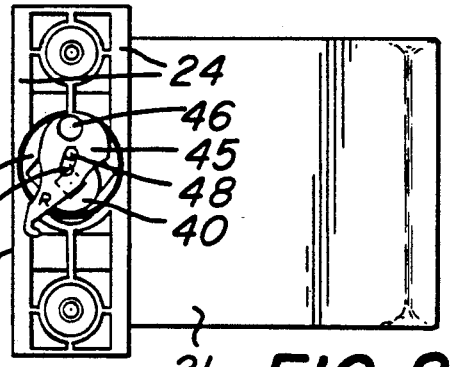
FIG. 2
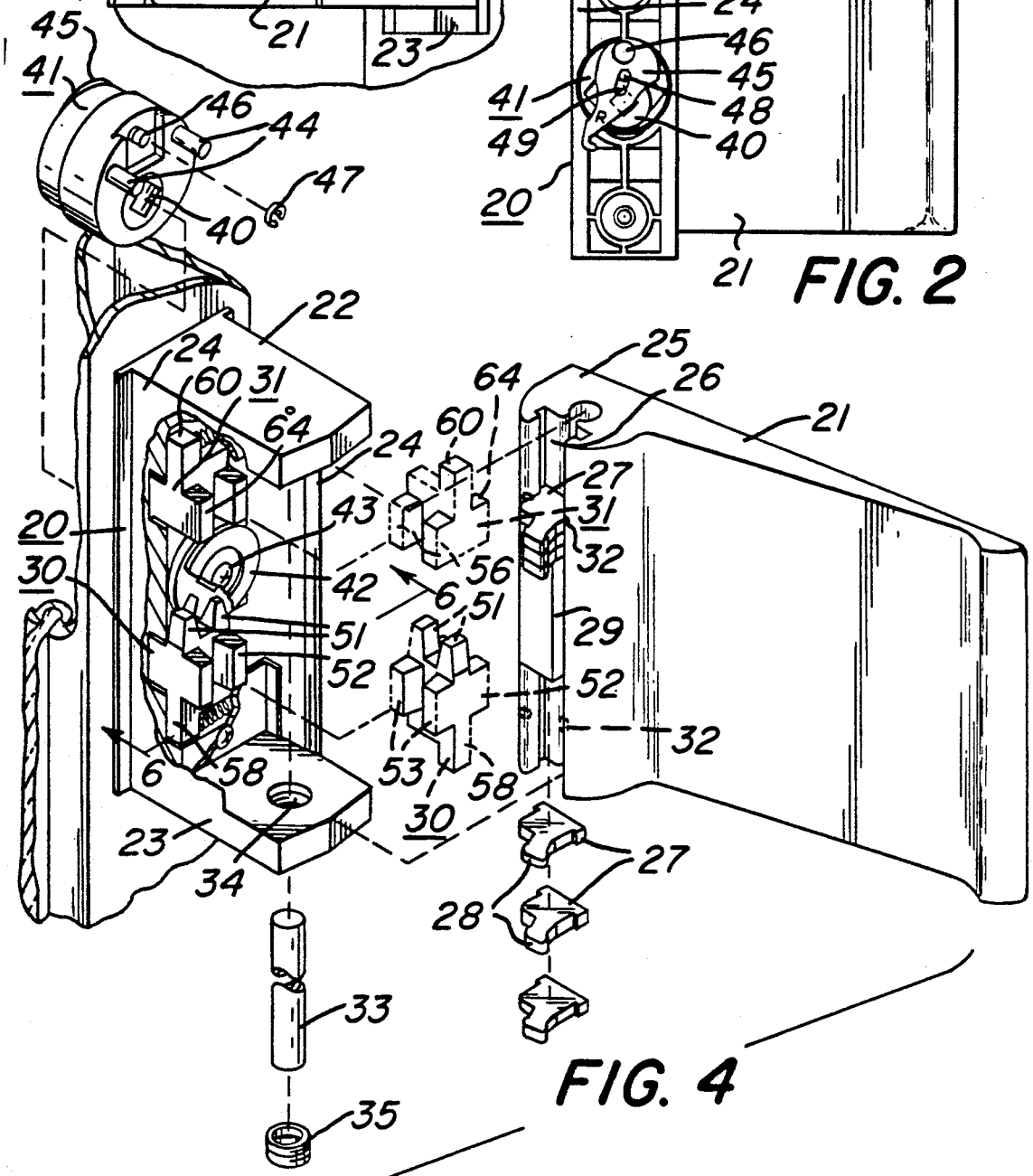
FIG. 4

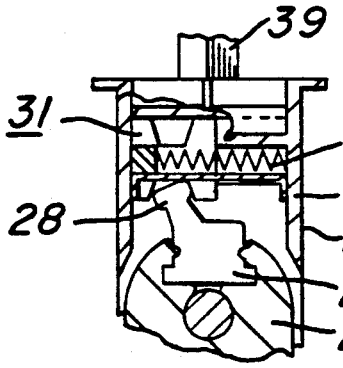
FIG. 9
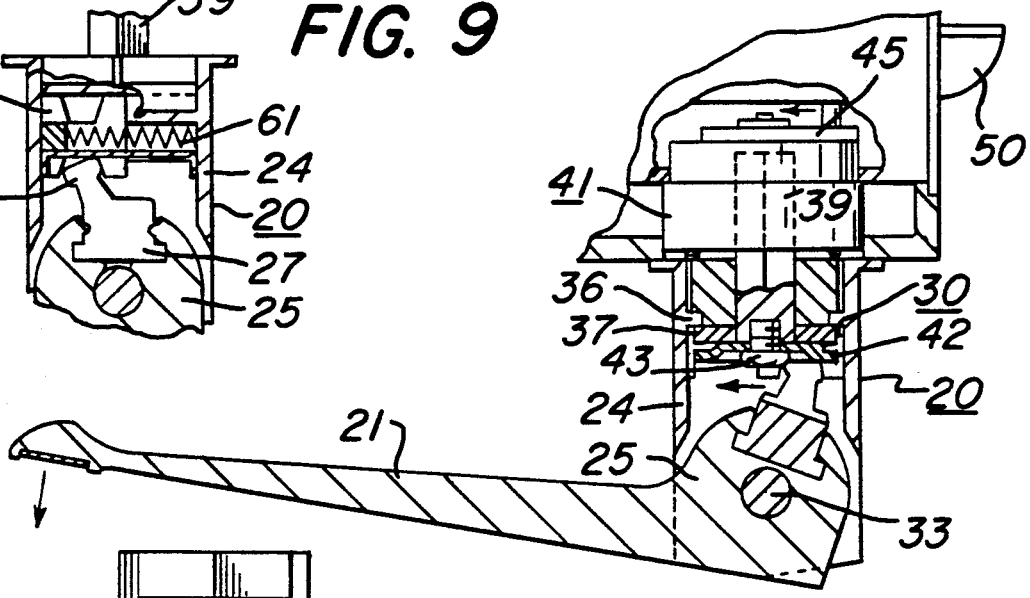
FIG. 10
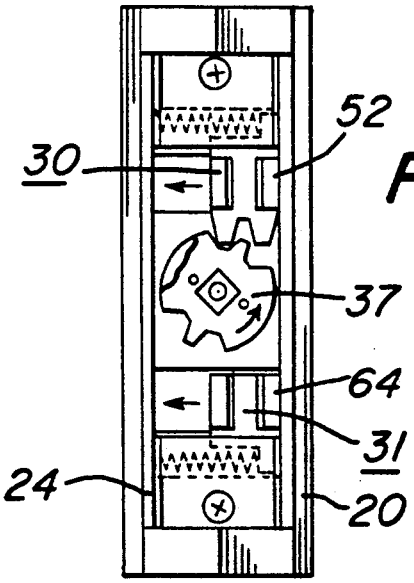
FIG. 11
FIG. 13
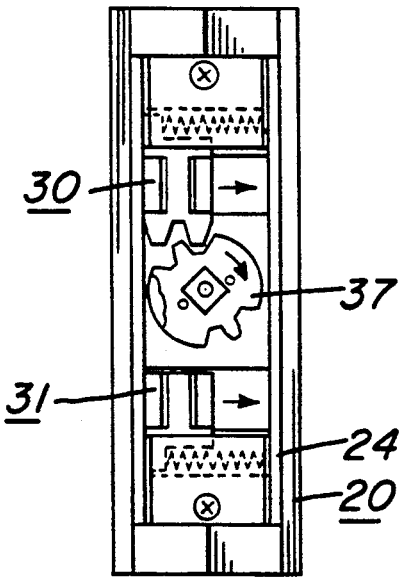
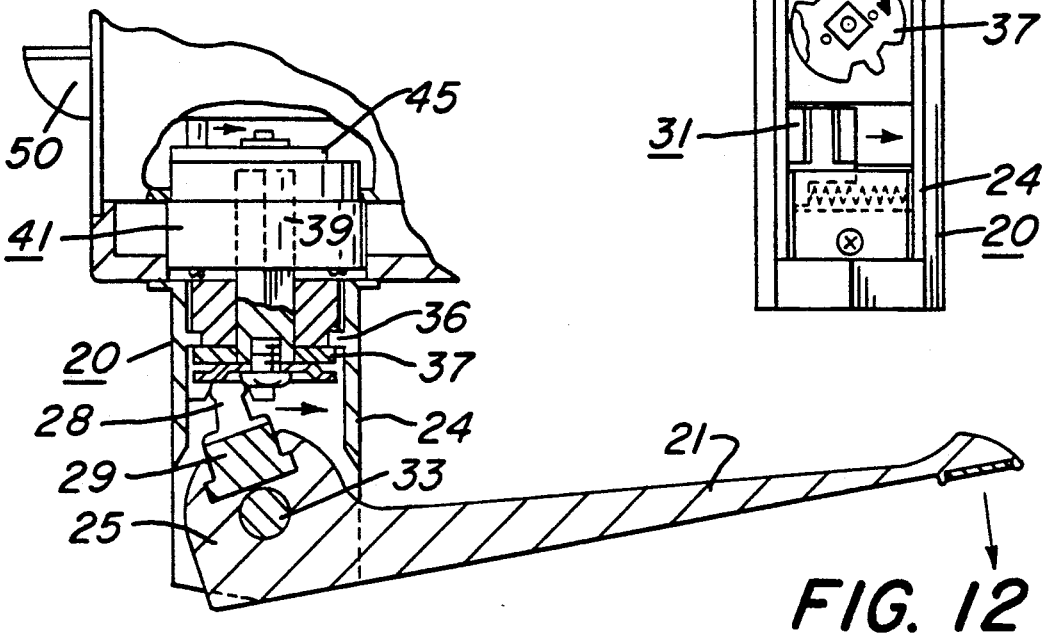
FIG. 12

PADDLE LATCH DEVICE

This invention relates generally to latch devices for doors, and more particularly to narrow stile doors which may be hinged either on the left side or on the right side, and which utilize a push or pull actuator for retracting the latch instead of utilizing a rotary knob for that purpose.

Paddle latch devices per se are not new in the art. Such devices, in common with rotary knob latch actuators, all utilize a rotary latch retractor mechanism. The rotary knob types use the direct rotational action of hand turning a door knob to rotate the rotary latch retractor. The paddle type devices all utilize some form of linear to rotary motion converter to effect rotation of the rotary latch retractor by means of a linear push or pull against the hand actuated paddle of the latch device. In the past, different types of linear to rotary motion converters have been utilized. In one form of device a toothed rack plate is moved by the paddle device against the teeth of a rotary gear which provides the linear to rotary motion conversion. In other devices, other types of geared structures are used.

The device according to the invention also utilizes inter-engaged toothed devices to provide the linear to rotary motion required. However, the present invention utilizes a novel configuration of parts which permits one set of parts to be utilized to provide either a push or a pull actuation for latch retraction with either a right hand or left hand door. In the past, the structures available have been such as to require differently configured parts to provide the various desired functions of left hand push, left hand pull, right hand push or right hand pull. Thus, it was necessary to manufacture and inventory a large number of parts to accommodate all four of the desired uses. This multiple manufacture and inventory requirement of the past is no longer necessary with the paddle latch device according to the invention.

It is a primary object of the invention to provide a novel paddle latch device capable by rearrangement of one standard set of parts to provide push and pull functions for either left hand or right hand door mounting.

Another object of the invention is to provide a novel paddle latch device as aforesaid which includes a standard rotary latch actuator.

A further object of the invention is to provide a novel paddle latch device as aforesaid which utilizes a novelly configured gear driver engageable with both the hand actuated paddle and with a rotatable gear which drives the rotary latch actuator.

The foregoing and other objects of the invention will become clear from a reading of the following specification in conjunction with an examination of the appended drawings, wherein:

FIG. 1 shows the paddle latch device mounted to the right side of a door, and which may be operated in either a push or a pull mode;

FIG. 2 shows the reverse side of the paddle latch device of FIG. 1 demounted from the door and showing the rotary door latch actuator set up for utilization at the right side of the door;

FIG. 3 is a fragmentary view similar to FIG. 2 but showing the rotary latch retractor set up for use at the left side of the door;

FIG. 4 is a partially exploded isometric view of the paddle latch device according to the invention showing the inter-relationship of the major parts;

FIG. 9 is a detail view showing engagement of the paddle driver with the rotary gear driver as would be seen when viewed along the line 9—9 on FIG. 6;

FIG. 10 is similar to the showing of FIG. 5 with the components arranged to provide a pull actuation for the right side of the door rather than a push actuation;

FIG. 11 is similar to the showing of FIG. 6 but shows the arrangement of parts corresponding to that of FIG. 10;

FIG. 12 is similar to the showing of FIG. 7 with the parts arranged for left door side pull motion rather than the push actuation of FIG. 7;

FIG. 13 is similar to the showing of FIG. 8 except that the parts are arranged for the pull actuation corresponding to the showing of FIG. 12;

In the several figures, like elements are denoted by like reference characters.

Figure 5:
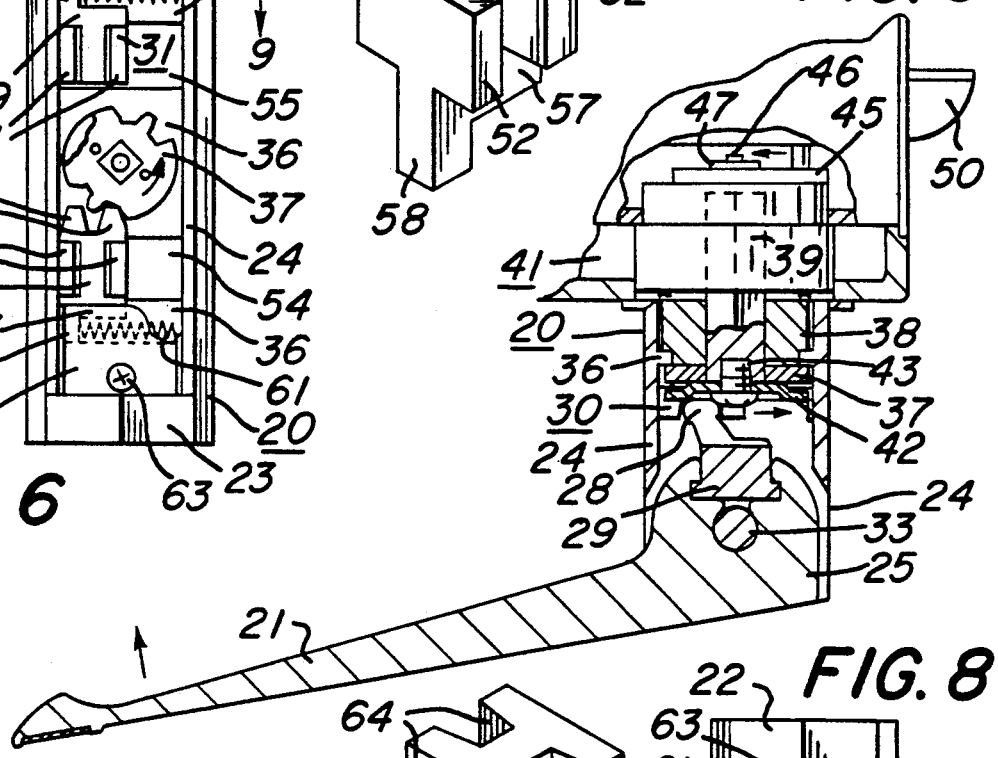
FIG. 5 is a sectional view through a paddle latch device according to the invention mounted to the right side stile of the door for push actuation as would be seen when viewed along the line 5—5 on FIG. 1.

The invention will first be described in connection with a right side mounted push mode operation, and will be thereafter described in the other modes. In this regard attention should first be directed to FIGS. 1, 2, 4, 5, 6 and 9 of the drawings. As best seen in FIGS. 1, 2, 4 and 5, the latch device case is designated generally as 20 and the paddle actuator is designated generally as 21. As best seen in FIG. 4 the latch device case 20 has top and bottom end walls 22 and 23 and a pair of opposite side walls 24, one of which latter is shown cut away to reveal the arrangement of the inner working parts. As best seen in FIGS. 4 and 5, the paddle 21 has a thickened formation 25 at one end provided with a keyed slot 26 within which are disposed two sets of driver slugs 27 formed with driver ears 28. Between the two sets of driver slugs 27 is a spacer bar 29 which properly positions the driver slugs for engagement with the gear driver 30 and follower 31. The driver slugs are held firmly in position against the spacer bar 29 by two sets of stakings 32. The paddle is held in its pivotally assembled position between the top and bottom end walls 22 and 23 by means of a pin 33 projected through a threaded hole 34 in the bottom end wall 23 and into a circular recess seat in the top end wall 22. The pin 33 is retained in place by means of a threaded thimble 35 which screws into the threaded hole 34 in the bottom end wall 23.

Figure 6:
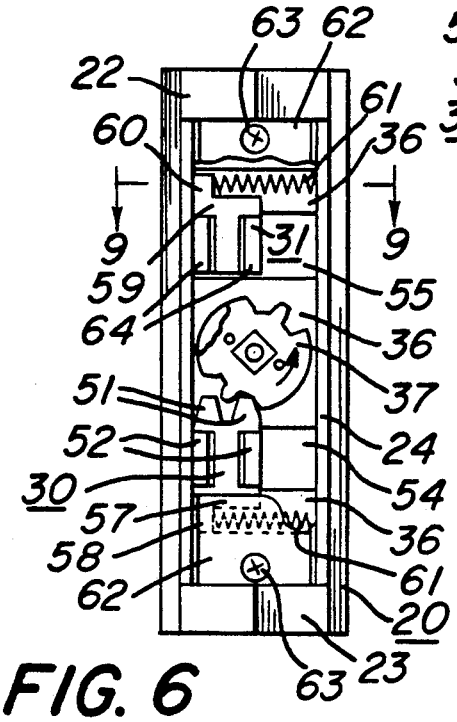
FIG. 6 is an elevational view of the partly exploded device according to the invention as would been seen when viewed along the line 6—6 on FIG. 4.

As best seen in FIGS. 4, 5 and 6, centrally located within the case 20 and seated against the case bottom wall 36 is a rotary gear 37. Seated within an outside circular socket formed in the case bottom wall 36 is circularly cylindrical portion 38 of a rotary latch driver actuator which also includes a square shaft 39, one end of which latter is centrally keyed into the rotary gear 37 as best seen in FIG. 6. The other end of the shaft 39 projects beyond the base wall of the case 20 for keyed engagement within the rotary shaft 40 of the rotary latch driver designated generally as 41 and best seen in FIG. 4. The end of the square shaft 39 which is keyed into the rotary gear 37 is covered by a centrally apertured circular plate 42 and is secured to the plate 42 and gear 37 by means of the machine screw 43.

The rotary latch driver 41 is non-rotatably keyed to the base wall of the latch driver case by means of a pair of pins 44, best seen in FIG. 4, which project into properly sized holes (not seen) in the base wall of the latch device case. These pins 44 keyed to the case prevent the rotary latch driver 41 from itself rotating when the square shaft 39 which is projected into the rotary shaft 40 is rotated to drive the latch retractor arm 45 best seen in FIGS. 2 and 5.

The latch retractor arm 45 is held to the outer face of the rotary latch driver 41 by means of a headed pin 46 secured by a C-ring 47. As best seen from FIG. 2, the outer face of the rotary shaft 40 terminates just short of the inner face of the latch retractor arm 45, and a pin formation 48 extending from the outer face of the rotary shaft 40 projects through a slot 49 in the latch retractor arm 45. The hook end of the latch retractor 45 is engageable with the door latch mechanism for retraction of the latch 50 best seen in FIG. 5. In the push mode of FIGS. 2 and 5, rotation of the gear 37 causes rotation of the shaft 39 and 40 to move the latch retractor arm 45 to the right as shown in FIG. 2 and to the left as shown by the arrow in FIG. 5 to thereby retract the door latch 50.

The latch retractor arm 45 has to be reversed front for back when it is desired to use the latch device at the left side of the door, and this is shown in FIG. 3 where it is observed that the latch retractor arm has been flipped over. This is accomplished by removing the C-ring 47 from the end of the headed pin 46, withdrawing the pin 46 and reversing the latch retractor arm 45 front for back, then reinserting the pin and securing it with the C-ring 47. This is part of the switchover for utilizing the latch drive device at the left side of the door instead of at the right side, as will be more fully described hereinafter.

Figure 14:
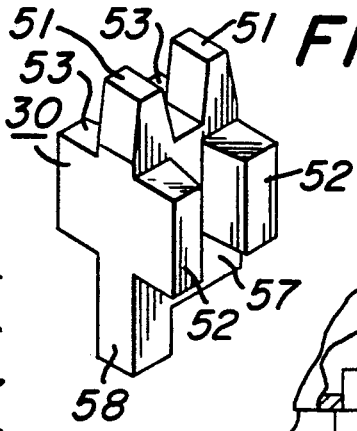
FIG. 14 is an isometric showing of the driver element engageable with both the actuating paddle and the rotary gear.
Figure 8:
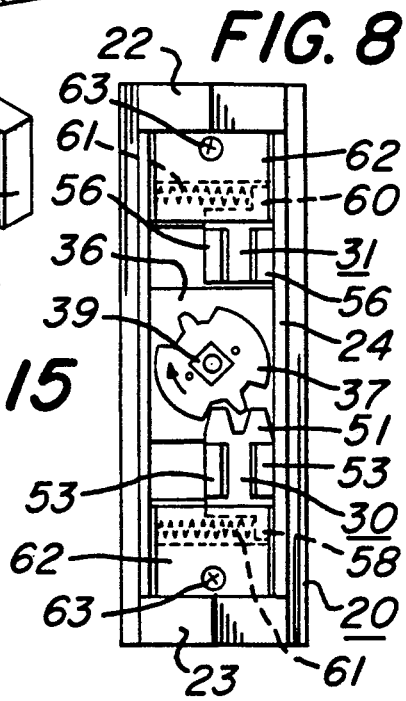
FIG. 8 is similar to the showing of FIG. 6 but discloses the arrangement of parts for the left side door push mode of FIG. 7.

The rotation of the rotary gear 37 is effected by means of the gear driver 30 best seen in FIGS. 2, 6 and 14. The gear driver 30 has a pair of gear driving teeth 51 which mesh with the teeth of the rotary gear 37 for rotating the gear when the gear driver is itself linearly shifted by the driver ears 28 when the paddle 21 is pushed. The driver ears 28 are disposed between either the gear driver lugs 52 as shown in FIGS. 4 and 6, or disposed between the gear driver lugs 53 as shown in FIG. 8 to be subsequently described. As best seen from FIG. 6, the non-visible gear driver lugs 53 are disposed within a slot 54 formed in the base wall of the case 20. A similar slot 55 is formed for the lugs 56 of the follower 31, to be more fully described hereafter.

As shown in FIG. 6, the web 57 and tail piece 58 of the gear driver are seated for sliding movement on top of the portion of the case bottom wall below the slot 54, while the web 59 and tail piece 60 of the follower 31 are seated on the portion of the case bottom wall 36 above the slot 55. Disposed between the tail pieces 58 and 60 of the gear driver and follower and one of the case side walls 24 are a pair of compression springs 61 which bias the gear driver and the follower against the opposite case side wall 24. When the driver ears 28 disposed between gear driver lugs 52 and the follower lugs 64 are actuated by a push on the paddle 21, the gear driver 30 and follower 31 are driven laterally against the pressure of the springs 61 toward the opposite side wall 24 so that the gear 37 is rotated to actuate the door latch 50. The release of pressure on the paddle 21 removes the compression pressure on the springs 61 which return the gear driver 30 and follower 31 back to their initial positions.

The springs 61 and tail pieces of the gear driver 30 and follower 31 are covered by cover plates 62 which are secured by screws 63 to prevent the springs and gear driver and follower from working their way out of position under constant use. The circular plate 42 also partially covers the driver teeth of the gear driver 30 so that the gear driver 30 is trapped beneath the circular plate 42 and the cover plate 62. The follower 31 maintains a balanced mechanical structure within the latch device and provides part of the return spring action on the paddle 21.

Figure 7:
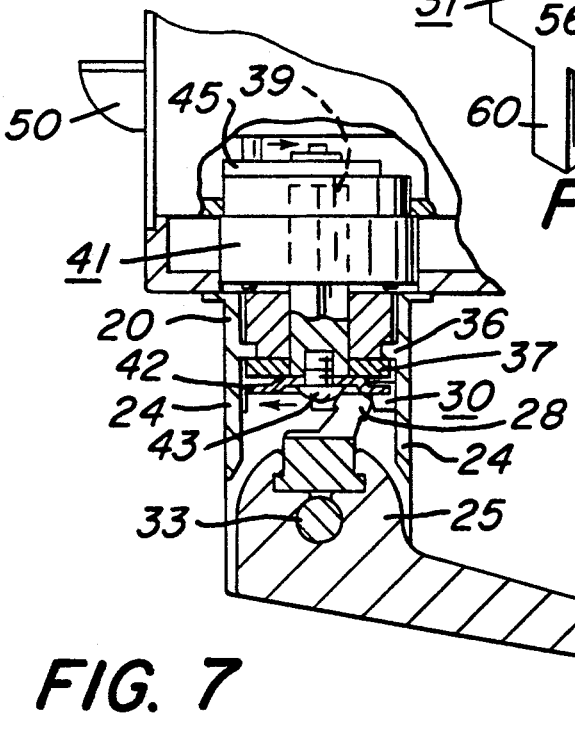
FIG. 7 is a view similar to that of FIG. 5 but in which the arrangement of parts is such that the paddle latch device operates in the push mode for the left side of the door.
Figure 15:
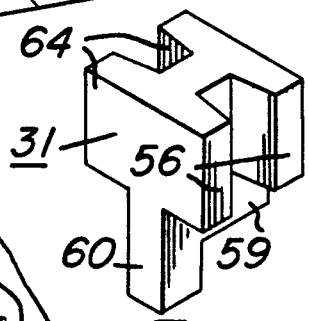
FIG. 15 is an isometric view of a load balancing follower element engageable with the paddle actuator but which does not engage the rotary gear which drives the latch retractor.

FIGS. 3, 7 and 8 illustrate the changes for converting the paddle latch device for use as a push actuator at the left side of the door instead of at the right side of the door. FIG. 3 has already been described with regard to the changeover of the latch retractor arm 45. FIGS. 7 and 8 show the changes required to be made to the rotary gear 37, and to the gear driver 30 and follower 31. Changeover of the rotary gear 37 is effected by removing the machine screw 43 and circular plate 42 to expose the gear 37. The gear is then flipped over, or rotated 90 degrees, and reseated upon the end of the square shaft 39, followed by replacing the circular plate 42 and machine screw 43 so that the gear 37 now is positioned as shown in FIG. 8. The screws 63 and plates 62 are also removed so that the gear driver 30 and follower 31 may be rotated 180 degrees from left to right to occupy positions as shown in FIG. 8. The springs 61 are then reinserted and the cover plates 62 and screws 63 again installed. The paddle 21 is then reversed from the position shown in FIG. 5 to that shown in FIG. 7 and reinstalled.

FIGS. 10 and 11 illustrate the arrangement of the parts for operating the device as a pull latch release with the latch device mounted at the right side of the door. Since this is a right side actuation, the latch retractor arm 45 is mounted as shown in FIG. 2, and the rotary gear 37 remains in the same position as shown in FIG. 6. The change that is required is in the positions of the gear driver 30 and the follower 31. It will be observed that the gear driver lugs 52 and the follower lugs 64 are the lugs engaged by the driver ears 28, just as in the showing of FIG. 6. However, the positions of the gear driver 30 and follower 31 have been interchanged and also moved from the left side to the right side, again through the removal of the cover plates 62 and screws 63, after which these elements are replaced as shown. The position of the paddle 21 instead of extending outwardly away from the door is positioned slightly inward toward the door as shown by comparison of FIGS. 10 and 5.

Finally, the positions of the parts for installing the latch paddle device at the left side of the door for pull operation is shown in FIGS. 3, 12 and 13. As best seen in FIG. 13, the rotary gear 37 is in the same position as shown in FIG. 8, while the position of the gear driver 30 and follower 31 have again been interchanged as shown in FIG. 11 excepting that they have been flipped over to the left side as shown in FIG. 6. The actuating paddle 21 as shown in FIG. 12 for pull actuation occupies the same relative position to the door as does the paddle shown in FIG. 10. From the foregoing it is seen that one set of component parts allows the latch paddle device according to the invention to be simply set up in any one of four modes of operation, and that it is relatively easy to change the type of operation to any of the other desired types in a very simple manner.

FIGS. 16 through 19 illustrate a slightly different configuration of the driver slugs 27 shown in the previously described figures in order to allow the paddle 21 to be oriented substantially parallel to the plane of the door for both the push and pull modes of operation. The operating end of the paddle 21 in the pull mode showings of FIGS. 10 and 12 can be positioned too close to the surface of the door, and some users may prefer that it be spaced further away. This requires a change in the configuration of the driver slugs 27 and associated driver ears 28. This change is shown in FIGS. 16 through 19 where it can be seen that all of the operating components of the system are the same except for a few differences. The main difference is that the driver slugs 27A are provided with driver ears 28A which are so positioned relative to the body of the driver slug that each of the slugs is configured with mirror image symmetry about a straight line, whereas in the showing of FIG. 4 it is clear that the driver slugs 27 with their ears 28 are asymmetric. The positional shift of the driver ears 28A relative to the driver slugs 27A results in positioning of the paddle 21 horizontally with regard to the plane of the door to which the latch device is secured, as clearly seen by comparison of FIG. 18 with FIG. 10, and comparison of FIG. 19 with FIG. 12. This shift in the paddle orientation is brought about solely by the configurational change of the driver slugs ears 28A.

Figure 18:
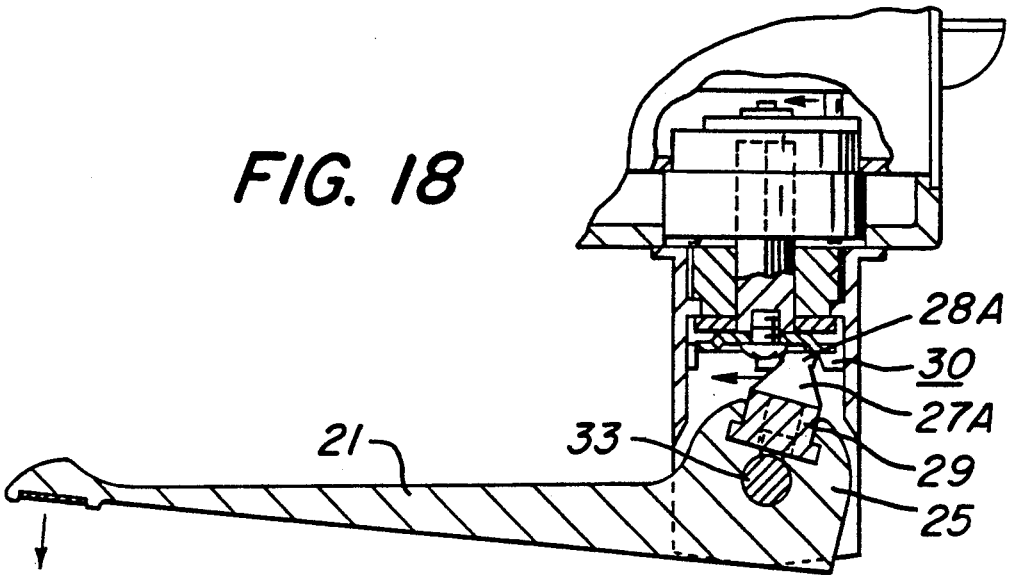
FIG. 18 is a showing similar to that of FIG. 10, but utilizing driver slugs with driver ears oriented differently to provide a different orientation of the actuator paddle.
Figure 16:
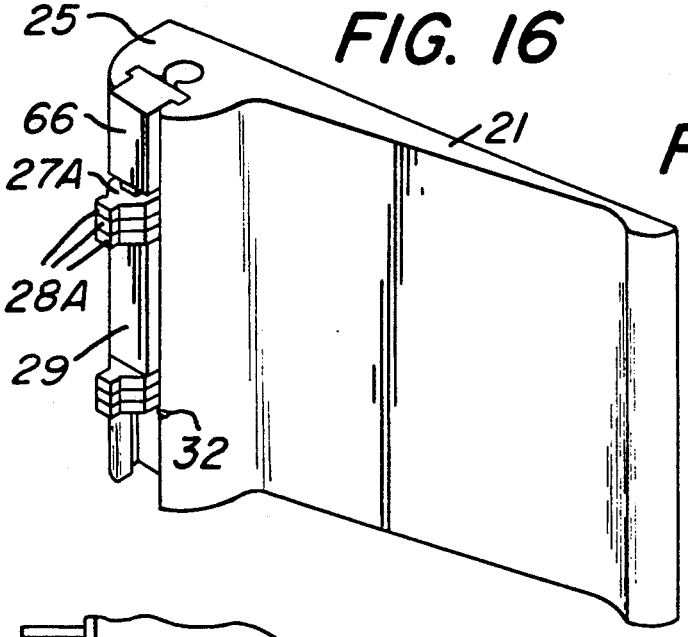
FIG. 16 is an isometric view of an alternative configuration of paddle for utilizing different driver slugs assemblies.
Figure 17:
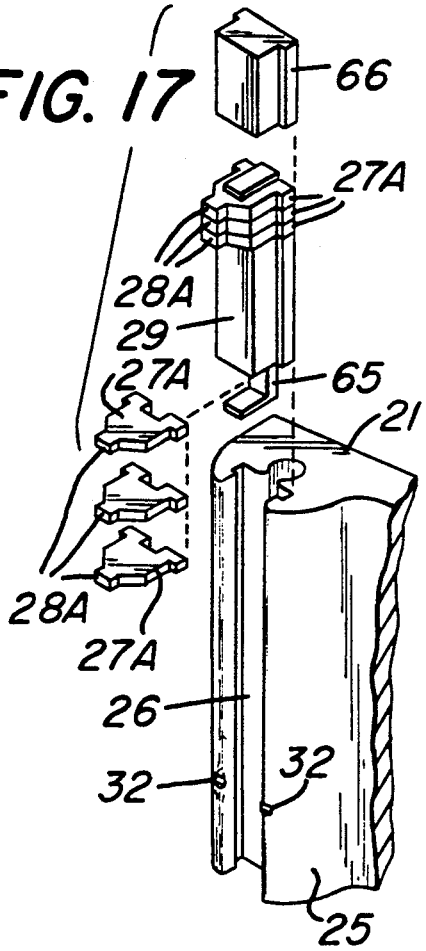
FIG. 17 is an exploded isometric view of the assembly shown in FIG. 16, more clearly showing the parts of the assembly.
Figure 19:
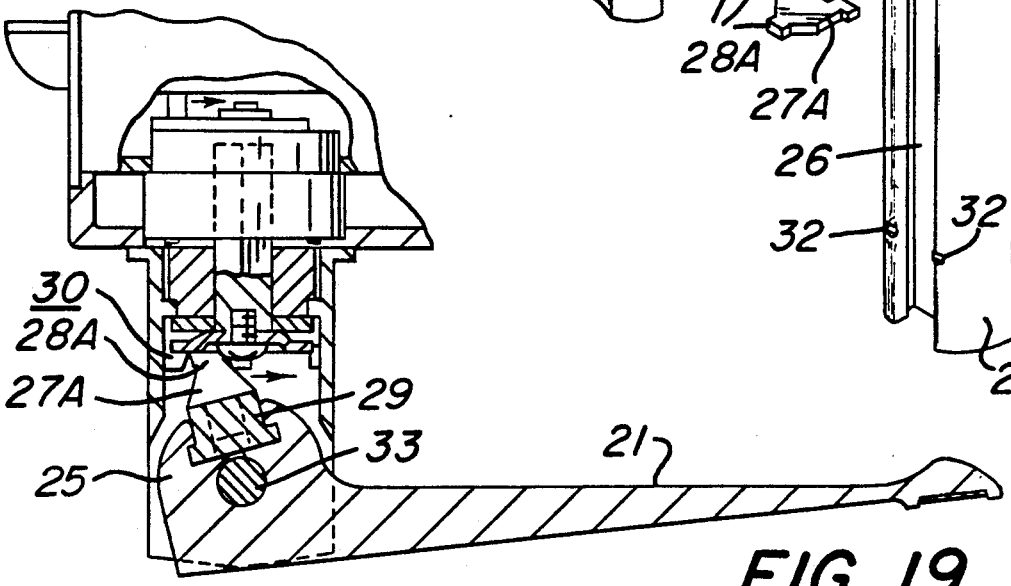
FIG. 19 is a showing similar to that of FIG. 12 for the pull mode, but utilizing driver slugs having driver ears oriented differently to provide a different orientation of the actuator paddle.
Figure 20:
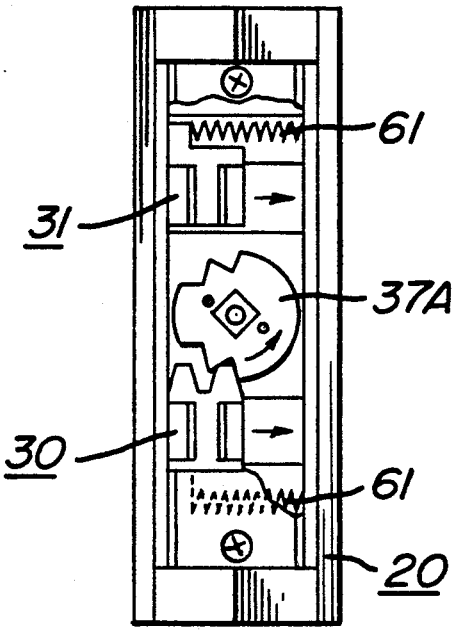
FIGS. 20 to 23 show an embodiment of the invention utilizing a differently configured driver gear.
Figure 21:
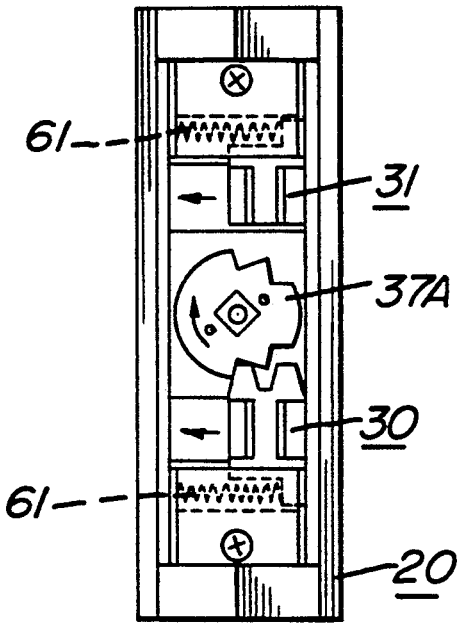
Figure 22:
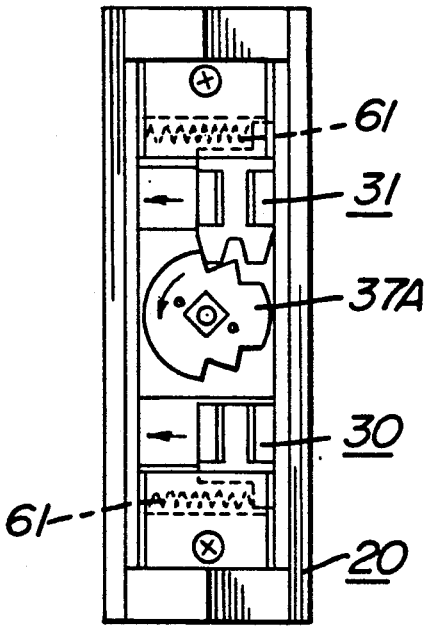
Figure 23:
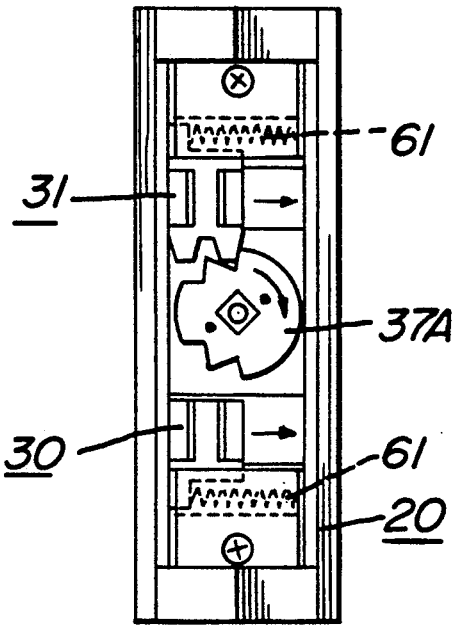

The second difference is that as distinguished from the showing of FIG. 4 in which the driver slugs and spacer bar 29 are held in position in the keyed slot 26 of the paddle 21 by a pair of stakings 32, the arrangement as best seen in FIGS. 16 and 17 provides for the use of interchangeable driver slug configurations. As shown in FIGS. 16 and 17, only one set of stakings 32 is used as a positional stop device. Additionally, the driver slugs 27A are assembled with the spacer bar 29 as a unit and are secured together by means of the clip 65. Accordingly, the entire unit may be slipped into the keyed slot 26 for positioning against the stakings 32, and end spacer bar 66 may then be inserted into the keyed slot 26 to prevent backshifting of the driver slugs unit within the keyed slot 26. The end spacer bar 66 thus replaces a second set of stakings 32. This arrangement permits the use of driver slugs assemblies having different driver ears orientations. For example, an assembly of driver slugs characterized by driver ears 28 as shown in FIG. 8 could constitute one assembly for use in the push mode as shown in FIGS. 5 and 7, while a second assembly having driver ear configurations 28A as shown in FIGS. 16 through 19 can be used for a pull mode configuration as shown in FIGS. 18 and 19. Accordingly, by providing two different driver slug units, the user of the paddle latch device is enabled to select a most appropriate driver slugs unit for the particular mode of operation desired.

It is also possible by reducing the offset angle of the driver ears 28 toward the position of the driver ears 28A to provide one driver assembly which causes the push mode angle of the paddle 21 to be more parallel to the plane of the door than is shown in FIGS. 5 and 7, and to also by reversal cause the pull mode angle of the paddle 21 to be more parallel to the plane of the door than is shown in FIGS. 10 and 12. Accordingly, one reversible driver slugs assembly of the type shown in FIGS. 16 and 17 can provide acceptable push and pull mode operation, with the angle of the paddle 21 to the plane of the door being controlled by the offset angle of the driver slugs ears.

FIGS. 20 to 23 are showings similar to FIGS. 6, 8, 11 and 13 but utilizing a differently configured driver gear 37A. The gear 37 is slightly asymmetric but not visually clearly so. This can result in improper positioning when operating functions are being changed if care is not exercised to be sure that the gear placement is accurate. The gear 37A avoids this problem since it has mirror image symmetry front and back.

Having now described the invention in connection with a particularly illustrated embodiment thereof, modifications and variations of the invention may now naturally occur from time to time to those persons normally skilled in the art without departing from the essential scope and spirit of the invention, and accordingly it is intended to claim the invention broadly as well as specifically as indicated by the appended claims.

What is claimed is:

1. A door latch retraction device for doors which may be hinged at either the left side or the right side and which utilizes a paddle type actuator in a selected one of a push or pull mode, comprising in combination, a) a generally rectangular case (20) having a base wall (36), top (22) and bottom (23) spaced apart end walls and a pair of spaced apart side walls (24), b) a rotary gear (37) within said case having one of the gear faces disposed flatwise adjacent to said case base wall (36), c) a rotary shaft (39) secured to said rotary gear (37), with the cylindrical axes of said gear and shaft in alignment, and with said shaft extending through said case base wall (36) on the opposite side thereof from said rotary gear (37), d) a gear driver (30) for said rotary gear (37), said gear driver having a plurality of gear driving teeth (51) disposed in a common plane with and drivingly engageable with the teeth of said rotary gear (37), said gear driver also having first (52) and second (53) pairs of spaced apart lugs with one lug of each of said pairs of lugs lying in a first common plane orthogonal to the said plane of the said gear driving teeth (51), and with the other lug of each of said pairs of lugs lying in a second common plane orthogonal to the said plane of the said gear driving teeth (51), said first and second common planes being parallel spaced apart, and said planes of said first pair (52) and said second pair (53) of spaced apart lugs being parallel to and disposed on opposite sides of the said common plane of said gear driving teeth (51) and the teeth of said rotary gear (37), e) guide means (54 or 55) within which one of said pairs of first (52) and second (53) pairs of spaced apart lugs of said gear driver (30) is disposed for linear movement between said pair of case side walls (24, 24), f) biasing means (61) engaged with said gear driver (30) operative to resiliently bias said gear driver proximate to the inside face of one of said side walls (24) for movement along said guide means (54 or 55) away from said one case side wall (24) toward the opposite case side wall (24) to thereby rotate said rotary gear (37) and shaft (39) in a given direction when said gear driver (30) is moved linearly against said biasing means (61), and g) an actuator paddle (21) having driver ears (28/28A) extending laterally therefrom with said ears projecting into the space between the pair of spaced apart gear driver lugs (52 or 53) which are not disposed within said guide means (54 or 55), said paddle (21) being positioned between said case end walls (22, 23) for swinging movement about an axis transverse to the line of movement of said gear driver (30).

2. A door latch retraction device as set forth in claim 1 wherein said guide means are plural (54, 55) and wherein said gear driver (30) is positionable within said case (20) in any of four selectable positions within said guide means, a first two of said four selectable positions being within one of said plural guide means (54) adjacent to the inside face of each of said side walls (24), and a second two of said four selectable positions being within another one of said plural guide means (55) adjacent to the inside face of each of said sidewalls (24), whereby, in one of said first two selectable positions said latch retraction device is mountable at the left side of a door in actuator paddle push mode and in the other of said first two selectable positions said latch retraction device is mountable at the right side of a door in actuator push paddle mode, and whereby in one of said second two of four selectable positions said latch retraction device is mountable at the left side of a door in actuator paddle pull mode and in the other of said second two of four selectable positions said latch retraction device is mountable at the right side of a door in actuator paddle pull mode.

3. A door latch retraction device as set forth in claim 1 further including, a) a follower device (31) having first (56) and second (64) pairs of spaced apart lugs with one lug of each of said pairs of lugs lying in a first common plane orthogonal to the plane of said rotary gear (37), and with the other lug of each of said pairs of lugs lying in a second common plane orthogonal to the plane of said rotary gear (37), said first and second common planes being parallel spaced apart, and said planes of said first pair (56) and said second pair (64) of spaced apart lugs being parallel to and disposed on opposite sides of the plane of said rotary gear (37), b) second guide means (54 or 55) within which one of said pairs of first (56) and second (64) pairs of spaced apart lugs of said follower device (31) is disposed for linear movement between said pair of case side walls (24, 24), c) second biasing means (61) engaged with said follower device (31) operative to resiliently bias said follower device proximate to the inside face of one of said side walls (24) for movement along said second guide means (54 or 55) away from said one case side wall (24) toward the opposite case side wall (24), d) said actuator paddle (21) having additional driver ears (28) extending laterally therefrom with said additional driver ears projecting into the space between the pair of spaced apart follower device lugs (56 or 64) which are not disposed within said second guide means (54 or 55), said follower device (31) being disposed in said second guide means (54 or 55) when said gear driver (30) is disposed in said guide means (54 or 55) and vice-versa, and said gear driver (30) and follower device (31) being disposed in their respective guide means always adjacent to the same case side wall (24).

4. A door latch retraction device as set forth in claim 1 further including a rotary latch driver (41) having a latch retractor arm (45) drivingly engageable with the latch of a door when said latch retraction device is installed to a door, said latch retractor arm (45) being effective when operated by said rotary latch driver (41) to retract the door latch, said rotary latch driver (41) further including a rotary keying element (40) for driving said latch retractor arm (45), said rotary keying element being in keyed engagement with said rotary shaft (39) which latter is secured to said rotary gear (37) in indexed relationship.

5. A door latch retraction device as set forth in claim 1 further including a rotary latch driver (41) having a latch retractor arm (45) drivingly engageable with the latch of a door when said latch retraction device is installed to a door, said latch retractor arm (45) being effective when operated by said rotary latch driver (41) to retract the door latch, said rotary latch driver (41) further including a rotary keying element (40) for driving said latch retractor arm (45), said rotary keying element being in keyed engagement with said rotary shaft (39) which latter is secured to said rotary gear (37) in indexed relationship, said rotary gear (37) having two toothed sectors located diametrically across the gear from one another and having an untoothed sector between each of said toothed sectors.

6. A door latch retraction device as set forth in claim 1 wherein said driver ears are offset oriented so that the plane of the actuator paddle is non-parallel to the plane of the door to which the latch retraction device is securable.

7. A door latch retraction device as set forth in claim 1 wherein said driver ears are so oriented that the plane of the actuator paddle is parallel to the plane of the door to which the latch retraction device is securable.

8. A door latch retraction device as set forth in claim 2 further including a rotary latch driver (41) having a latch retractor arm (45) drivingly engageable with the latch of a door when said latch retraction device is installed to a door, said latch retractor arm (45) being effective when operated by said rotary latch driver (41) to retract the door latch, said rotary latch driver (41) further including a rotary keying element (40) for driving said latch retractor arm (45), said rotary keying element being in keyed engagement with said rotary shaft (39) which latter is secured to said rotary gear (37) in indexed relationship.

9. A door latch retraction device as set forth in claim 2 further including a rotary latch driver (41) having a latch retractor arm (45) drivingly engageable with the latch of a door when said latch retraction device is installed to a door, said latch retractor arm (45) being effective when operated by said rotary latch driver (41) to retract the door latch, said rotary latch driver (41) further including a rotary keying element (40) for driving said latch retractor arm (45), said rotary keying element being in keyed engagement with said rotary shaft (39) which latter is secured to said rotary gear (37) in indexed relationship, said rotary gear (37) having two toothed sectors located diametrically across the gear from one another and having an untoothed sector between each of said toothed sectors.

10. A door latch retraction device as set forth in claim 2 wherein said driver ears are offset oriented so that the plane of the actuator paddle is non-parallel to the plane of the door to which the latch retraction device is securable.

11. A door latch retraction device as set forth in claim 2 wherein said driver ears are so oriented that the plane of the actuator paddle is parallel to the plane of the door to which the latch retraction device is securable.

12. A door latch retraction device as set forth in claim 3 further including a rotary latch driver (41) having a latch retractor arm (45) drivingly engageable with the latch of a door when said latch retraction device is installed to a door, said latch retractor arm (45) being effective when operated by said rotary latch driver (41) to retract the door latch, said rotary latch driver (41) further including a rotary keying element (40) for driving said latch retractor arm (45), said rotary keying element being in keyed engagement with said rotary shaft (39) which latter is secured to said rotary gear (37) in indexed relationship.

13. A door latch retraction device as set forth in claim 3 further including a rotary latch driver (41) having a latch retractor arm (45) drivingly engageable with the latch of a door when said latch retraction device is installed to a door, said latch retractor arm (45) being effective when operated by said rotary latch driver (41) to retract the door latch, said rotary latch driver (41) further including a rotary keying element (40) for driving said latch retractor arm (45), said rotary keying element being in keyed engagement with said rotary shaft (39) which latter is secured to said rotary gear (37) in indexed relationship, said rotary gear (37) having two toothed sectors located diametrically across the gear from one another and having an untoothed sector between each of said toothed sectors.

14. A door latch retraction device as set forth in claim 3 wherein said gear driver (30) is positionable within said case (20) in a selected one of four selectable positions within said guide means and second guide means, a first two of said four selectable positions being within said guide means (54) adjacent to the inside face of each of said side walls (24), and a second two of said four selectable positions being within said second guide means (55) adjacent to the inside face of each of said sidewalls (24), whereby, in one of said first two selectable positions said latch retraction device is mountable at the left side of a door in actuator paddle push mode and in the other of said first two selectable positions said latch retraction device is mountable at the right side of a door in actuator push paddle mode, and whereby in one of said second two of four selectable positions said latch retraction device is mountable at the left side of a door in actuator paddle pull mode and in the other of said second two of four selectable positions said latch retraction device is mountable at the right side of a door in actuator paddle pull mode.

15. A door latch retraction device as set forth in claim 3 wherein said driver ears are offset oriented so that the plane of the actuator paddle is non-parallel to the plane of the door to which the latch retraction device is securable.

16. A door latch retraction device as set forth in claim 2 wherein said driver ears are so oriented that the plane of the actuator paddle is parallel to the plane of the door to which the latch retraction device is securable.

* * * * *